US009799944B2

(12) United States Patent
Kirovski et al.

(10) Patent No.: US 9,799,944 B2
(45) Date of Patent: Oct. 24, 2017

(54) PIFA ARRAY

(75) Inventors: Darko Kirovski, Kirkland, WA (US); Gerald DeJean, Redmond, WA (US); Miller Abel, Mercer Island, WA (US); Yingyi Zou, Redmond, WA (US); Craig Brenner, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 813 days.

(21) Appl. No.: 13/163,082

(22) Filed: Jun. 17, 2011

(65) Prior Publication Data

US 2012/0319919 A1 Dec. 20, 2012

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 21/29*** | (2006.01) |

(52) U.S. Cl.

CPC ..... *H01Q 1/243* (2013.01); *H01Q 9/0421* (2013.01); *H01Q 9/42* (2013.01); *H01Q 21/29* (2013.01)

(58) Field of Classification Search

CPC ..... H01C 1/243; H01C 9/0421; H01C 9/42; H01C 21/29

USPC ..... 343/853, 800 MS, 893, 700 MS

See application file for complete search history.

(56) References Cited

U.S. PATENT DOCUMENTS

| | | | | |
|---|---|---|---|---|
| 5,786,793 | A * | 7/1998 | Maeda et al. | 343/700 MS |
| 6,483,463 | B2 | 11/2002 | Kadambi | |
| 7,081,861 | B2 | 7/2006 | Steyn | |
| 7,164,933 | B1 * | 1/2007 | Steigerwald et al. | 455/562.1 |
| 7,202,826 | B2 * | 4/2007 | Grant et al. | 343/713 |
| 7,239,894 | B2 * | 7/2007 | Corbett et al. | 455/562.1 |
| 7,385,560 | B1 * | 6/2008 | Maloratsky et al. | 343/705 |
| 7,710,327 | B2 | 5/2010 | Saban et al. | |
| 7,800,546 | B2 | 9/2010 | Rao et al. | |
| 8,483,751 | B2 * | 7/2013 | Black et al. | 455/552.1 |
| 2003/0016175 | A1 * | 1/2003 | Zheng et al. | 343/700 MS |
| 2007/0001911 | A1 * | 1/2007 | Fujio | H01Q 9/0407 343/700 MS |

(Continued)

FOREIGN PATENT DOCUMENTS

JP 04133502 A * 5/1992

OTHER PUBLICATIONS

Han et al.; Reconfigurable monopolar patch antenna; Electronics Letters Feb. 4, 2010 vol. 46 No. 3.

(Continued)

*Primary Examiner* — Dieu H Duong

(57) ABSTRACT

A PIFA (Planar Inverted-F Antenna) array antenna has multiple PIFAs. The PIFA array is used to provide different radiation patterns for communication. A signal being emitted by the PIFA array is manipulated. According to the manipulation, the PIFA array may emit the signal with an omni-directional radiation pattern or a directional radiation pattern; the same PIFA array (antenna) is used for both directional communication and omni-directional communication. The PIFA array may be used in mobile computing devices, smart phones, or the like, allowing such devices to transmit directionally and omni-directionally. The signal manipulation may involve splitting the signal into components that feed PIFAs, and before the components reach the PIFAs, changing properties of the components (e.g., phase) relative to each other.

25 Claims, 14 Drawing Sheets

(56) References Cited

U.S. PATENT DOCUMENTS

| | | | | |
|---|---|---|---|---|
| 2007/0146210 | A1* | 6/2007 | Hilgers | 343/702 |
| 2007/0229366 | A1* | 10/2007 | Kim | H01Q 1/243 343/700 MS |
| 2008/0026797 | A1* | 1/2008 | Nanda | H01Q 1/246 455/562.1 |
| 2010/0045553 | A1* | 2/2010 | Ohira et al. | 343/749 |
| 2010/0231476 | A1* | 9/2010 | Chiang et al. | 343/780 |
| 2010/0295736 | A1* | 11/2010 | Su | 343/700 MS |

OTHER PUBLICATIONS

Saed; Broadband CPW—fed planar slot antennas with various tuning stubs; Progress in Electromagnetics Research, PIER 66, 2006.

Mak et al.; Isolation Enhancement between two closely packed Antennas; IEEE Transactions on Antennas and Propagation, vol. 56, No. 11, pp. 3411-3419, 2008.

Roascio et al.; Small satellite attitude determination with RF carrier phase measurement; IAC 2009.

Mosig et al.; Terminal Antennas for Mobile Applications: Design Considerations and Specific Examples; ISAP 2007.

Sani et al.; Directional Antenna Diversity for Mobile Devices: Characterizations and Solutions; MobiCom'10, Sep. 20-24, 2010, Chicago, Illinois, USA.

MediumWave Alliance: Antenna Handbook URL: web.archive.org/web/20081010160007/http://radiobrandy.com/AM-Short-Vertical-ants-2.html, 5 pages, Date: 2008.

Low Power Radio URL: lowpowerradio.blogspot.com/2011/01/tip-of-capacitive-hat.html, 3 pages, Date: Jun. 23, 2011.

Donohoe, Patrick and Jacob, Paul B. Lecture Notes, Antenna Arrays. URL: www.ece.msstate.edu/~donohoe/ece4990notes6.pdf, 29 pges, Date: 2002, Miss. State.

York, Robert. Lecture Notes, Antenna Arrays URL: my.ece.ucsb.edu/York/Bobsclass/144A/Handouts/Arrays.pdf, 5 pages Date: 2004, University of California in Santa Barbara.

Bevelacqua, P.J., PhD Dissertation: Antenna Arrays: Performance Limits and Geometry Optimization, URL: www.antenna-theory.com/Bevelacqua-Dissertation.pdf, 171 pages, Date: 2008, Arizona State University.

Milligan, Thomas A, Modern Antenna Design, Second Edition, 62 pages, Date: 2005, Publisher: IEEE Press, Wiley Interscience.

Pal, Siddharth et al.,Concentric Circular Antenna Array Synthesis using a Differential Invasive Weed Optimization Algorithm, URL: www.researchgate.net/publication/224211579_Concentric_Circular_Antenna_Array_synthesis_using_a_differential_Invasive_Weed_Optimization_algorithm, Hybrid Intelligent Systems (HIS), 2010 10th International Conference on, 6 pages.

Balanis, Constantine A., Antenna Theory Analysis and Design, Third Edition, 1072 pages, Date: 2005, Publisher: Wiley Interscience.

Bakshi, U.A. and Bakshi, A.V., Antennas and Wave Propagation, third edition, 369 pages, Date: 2009, Publisher: Technical Publications Pune.

Zhang, F. et al., Pattern Synthesis for Planar Array Based on Elements Rotation, URL: www.jpier.org/PIERL/pierl11/07.09070705.pdf Progress in Electromagnetics Research Letters, vol. 11, pp. 55-64, Date: 2009.

Camps, A., et al., Mutual coupling effects on antenna radiation pattern: An experimental study applied to interferometric radiometers, Radio Science, vol. 33, No. 6, pp. 1543-1552, Date: Nov.-Dec. 1998.

Tehseen Rahim, PhD Dissertation: Directional Pattern Synthesis in Circular Arrays of Directional Antennas, URL: discovery.ucl.ac.uk/1317595/1/257243.pdf, 230 pages, Date: 1980, Department of Electronic and Electrical Engineering, University College London.

Jian-Ming Jin and Douglas J. Riley, Finite Element Analysis of Antennas and Arrays, 47 pages, Feb. 23, 2009, John Wiley and Sons, Books.google.com.

* cited by examiner

PIFA ARRAY

BACKGROUND

In mobile devices, it is desirable to have antennas that are inexpensive yet efficient. While there have been many such antennas, previously, antennas with variable radiation patterns have not been widely used in mobile devices. Such antennas have not been used because it has not been considered feasible in terms of cost, scale, and gain. And, reasons to use such antennas have not previously been appreciated.

Regarding technical feasibility, consider that for commercial devices it is preferred to use inexpensive antennas for communication. However, these antennas provide only one type of radiation pattern. For WiFi and Bluetooth protocols, the radiation pattern is omni-directional. Other protocols such as the NFC (Near Field Communication) protocol use inductive coupling to communicate, and point-to-point communications require directional antennas. To date, there have been no antennas with cost and size suitable for mobile devices that can function as both directional and omni-directional antennas. Patch antennas are often used in mobile devices. However, these antennas can be affected by the substrate on which they reside, and inexpensive substrates tend to lower antenna gain.

Regarding desirability, there has not previously been appreciation of the possible uses of variant radiation pattern antennas in mobile devices. Because mobile devices are typically used in unpredictable or random orientations, directional radiation tends to be impractical; omni-directional radiation patterns allow for any device orientation. However, the present inventors have understood that mobile devices may be used in settings that are suitable for directional radiation patterns. For general-purpose mobile devices such as smart phones, cell phones, tablet-type computers, etc., directional communication may be desirable for security reasons; a directional link is difficult to intercept. Also, some uses may involve known orientations, allowing for a pre-determined radiation direction to be used. For instance, if a mobile device is near a terminal, for example a point-of-sale terminal or a proximity reader, a specific device orientation (and corresponding emission direction) can be easily accomplished by a person holding a device. For example, if a smart phone has directional capacity in a direction away from a back side of the smart phone, a person can point the back side of a smart phone toward a terminal when using the phone with the terminal. Even where security is not an issue, directional radiation, where possible, may help reduce power consumption. For example, sustained communication over a directional link might require less power than an omni-directional link.

Techniques related to antennas with selectable radiation patterns are discussed below.

SUMMARY

The following summary is included only to introduce some concepts discussed in the Detailed Description below. This summary is not comprehensive and is not intended to delineate the scope of the claimed subject matter, which is set forth by the claims presented at the end.

A PIFA (Planar Inverted-F Antenna) array antenna has multiple PIFAs. The PIFA array is used to provide different radiation patterns for communication. A signal being emitted by the PIFA array is manipulated. According to the manipulation, the PIFA array may emit the signal with an omni-directional radiation pattern or a directional radiation pattern; the same PIFA array (antenna) is used for both directional communication and omni-directional communication. The PIFA array may be used in mobile computing devices, smart phones, or the like, allowing such devices to transmit directionally and omni-directionally. The signal manipulation may involve splitting the signal into components that feed PIFAs, and before the components reach the PIFAs, changing properties of the components (e.g., phase) relative to each other.

Many of the attendant features will be explained below with reference to the following detailed description considered in connection with the accompanying drawings.

BRIEF DESCRIPTION OF THE DRAWINGS

The present description will be better understood from the following detailed description read in light of the accompanying drawings, wherein like reference numerals are used to designate like parts in the accompanying description.

DETAILED DESCRIPTION

A variable radiation-pattern antenna, to be suitable for mobile devices or other small-scale applications, should preferably be inexpensive yet provide sufficient gain whether in a directional mode or an omni-directional mode. While patch antennas are often used in mobile devices they have limitations such as high dependency on the dielectric constant of their substrate. Inexpensive substrates with low dielectric constants tend to require large patches. In addition, patch antennas do not have the ability to vary between a directional radiation pattern and an omni-directional radiation pattern. Dipoles are omni-directional, and Yagi-Uda arrays or other antennas requiring reflectors are impractical for small-scale applications.

Planar Inverted-F Antennas (PIFAs) have been used in many circumstances. While individual PIFA antennas can be compact, have efficient gain, may have a low profile, and are not overly dependent on a substrate, they nonetheless have not been used for providing both broadside (directional) communication and omni-directional communication. Nor have they been used in an array configuration.

Figure 1:
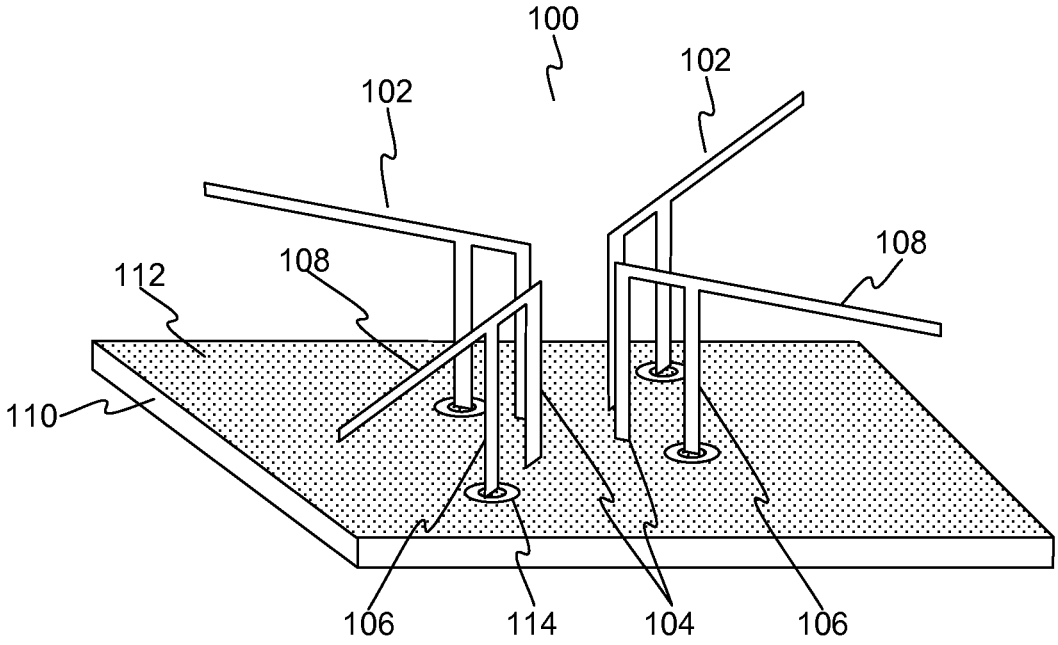
FIG. 1 shows an example of a PIFA array.

FIG. 1 shows an example of a PIFA array 100 that can provide directional and omni-directional radiation patterns for communication. The PIFA array 100 in FIG. 1 will be used as an example to illustrate broad features of PIFA arrays described herein. Other examples of PIFA arrays will be discussed later. The PIFA array 100 has multiple PIFAs 102 in a radial arrangement. Each PIFA 102, which resembles an inverted "F", may have a shorting pin or shorting element 104, a feed element 106 fed by a probe feed or the like (not shown), and a radiator or main element 108. In other embodiments, parasitic elements may be included. The PIFA array 100 also has a substrate 110, composed, for instance, of the FR-4 material (note that a variety of substrate materials can be used). A conductive layer 112 is aligned (co-planar) with the substrate 110, and may be layered directly on the substrate 110 or on one or more intermediate layers of various composition. A feeder circuit 130 (shown in FIG. 2 but not FIG. 1) is layered directly or indirectly on the substrate 110, opposite the PIFAs 102. The feeder circuit 130 feeds a signal (or split components thereof) to the PIFA array 100.

The shorting elements 104 are each directly electrically connected with the conductive layer 112. The feed elements 106 are isolated from the conductive layer 112 by separation areas 114, which are simply areas surrounding the feed elements 106 where there is no conductive material. In other words, the feed elements 106 do not electrically contact the conductive layer 112. The feed elements 106 pass through the substrate 110 to connect with the feeder circuit 130. It is possible to have a layer between the PIFAs 102 and the conductive layer 112, but it is not required for operation. An increase in mechanical stability might also result in reduced gain.

Figure 2:
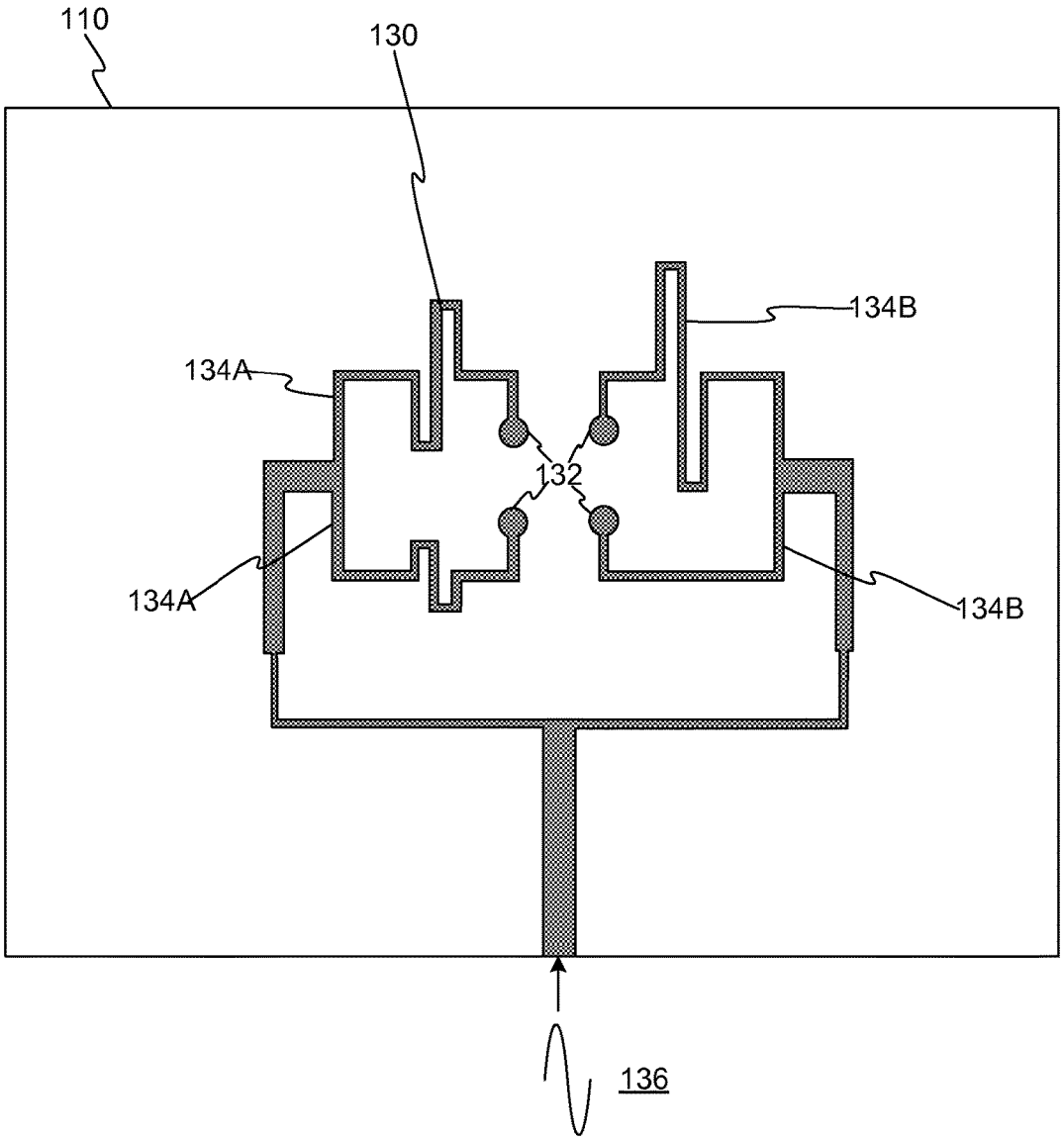
FIG. 2 shows feeder circuit on a substrate.

FIG. 2 shows feeder circuit 130 on the substrate 110. Contact pads 132 contact the feed elements 106. Conductive paths 134A, 134B, 134C, 134D connect a signal input 136 with the feed elements 106. The conductive paths 134A, 134B, 134C, 134D have varying path lengths to provide phase differences at the PIFAs 102. The feeder circuit 130 in FIG. 2 is for illustration only. In embodiments discussed later, a control circuit or other means adjusts phase differences according to whether directional or omni-directional communication is needed.

Figure 3:
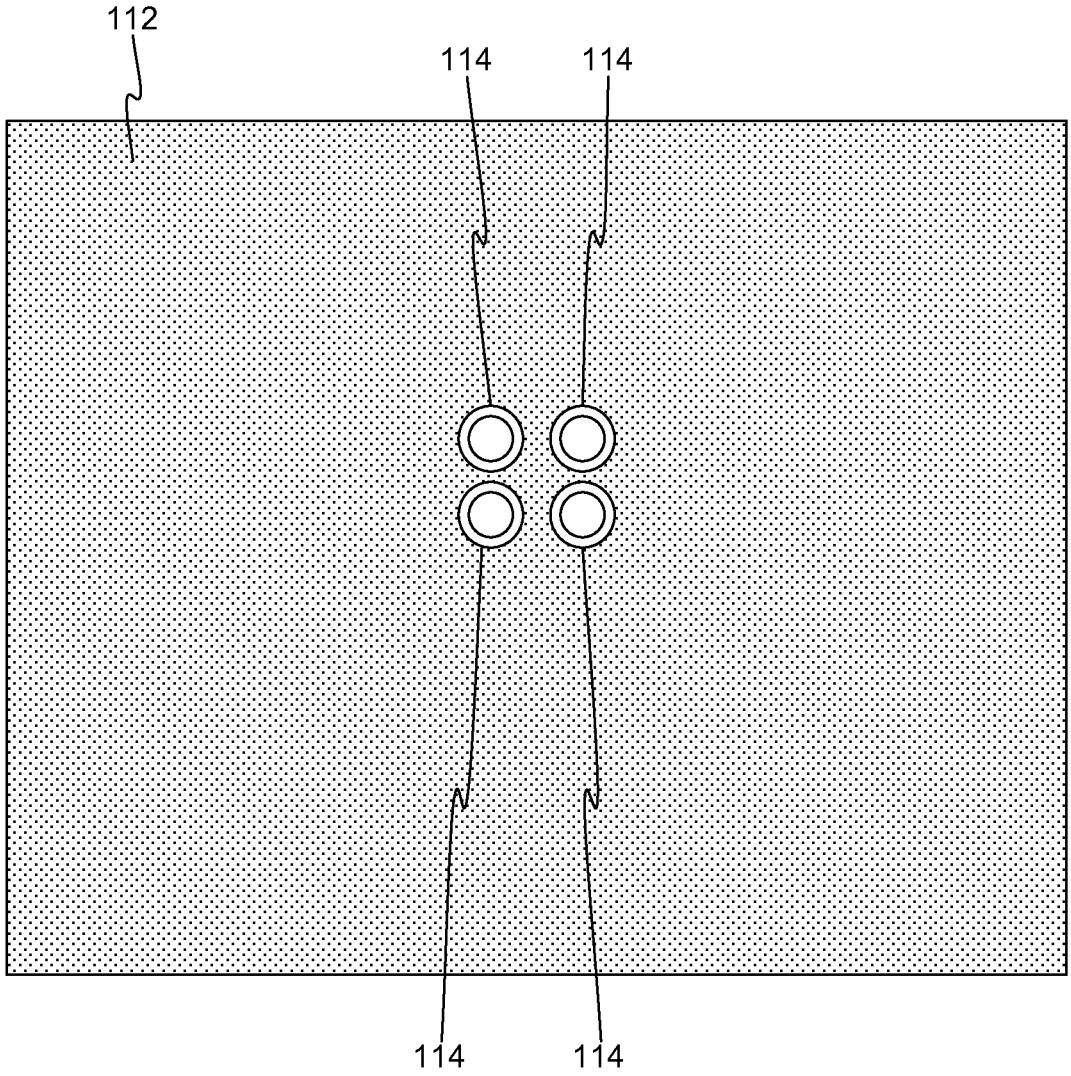
FIG. 3 shows an overhead view of conductive a layer and separation areas.

FIG. 3 shows an overhead view of conductive layer 112 and separation areas 114. The separation areas 114 may vary in number and location, according to the configuration and number of PIFAs in the PIFA array 100. The separation areas 114 may be rectangular, irregular, or have any shape that provides sufficient separation between the conductive material of the conductive layer 112 and the feeder elements 106.

Figure 4:
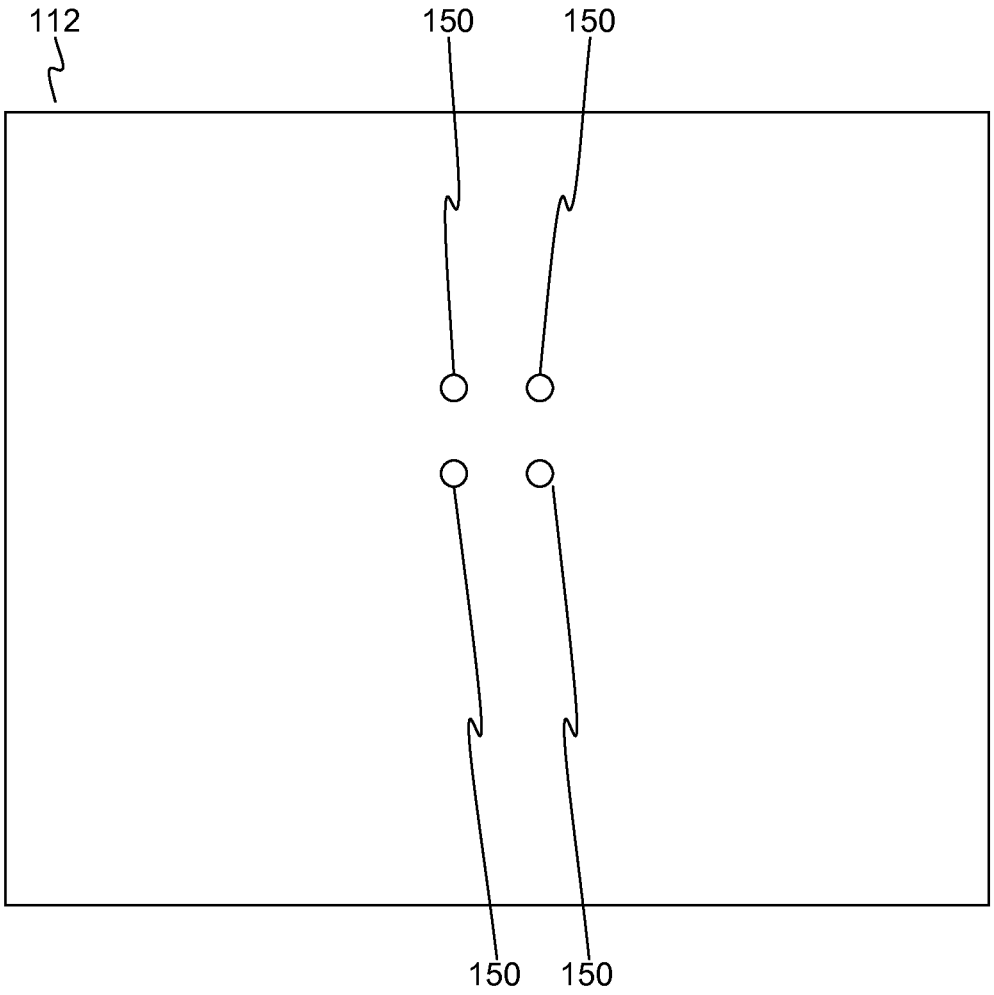
FIG. 4 shows a substrate with metallized openings.

FIG. 4 shows the substrate 110 with metallized openings 150. The feeder elements 106 pass through the openings 150 to connect with the feeder circuit 130. The shape of the openings 150 is not significant and can vary. The openings 150 may be conductive vias that connect the ground plane or conductive layer 112 to the feeder circuit 130.

Figure 5:
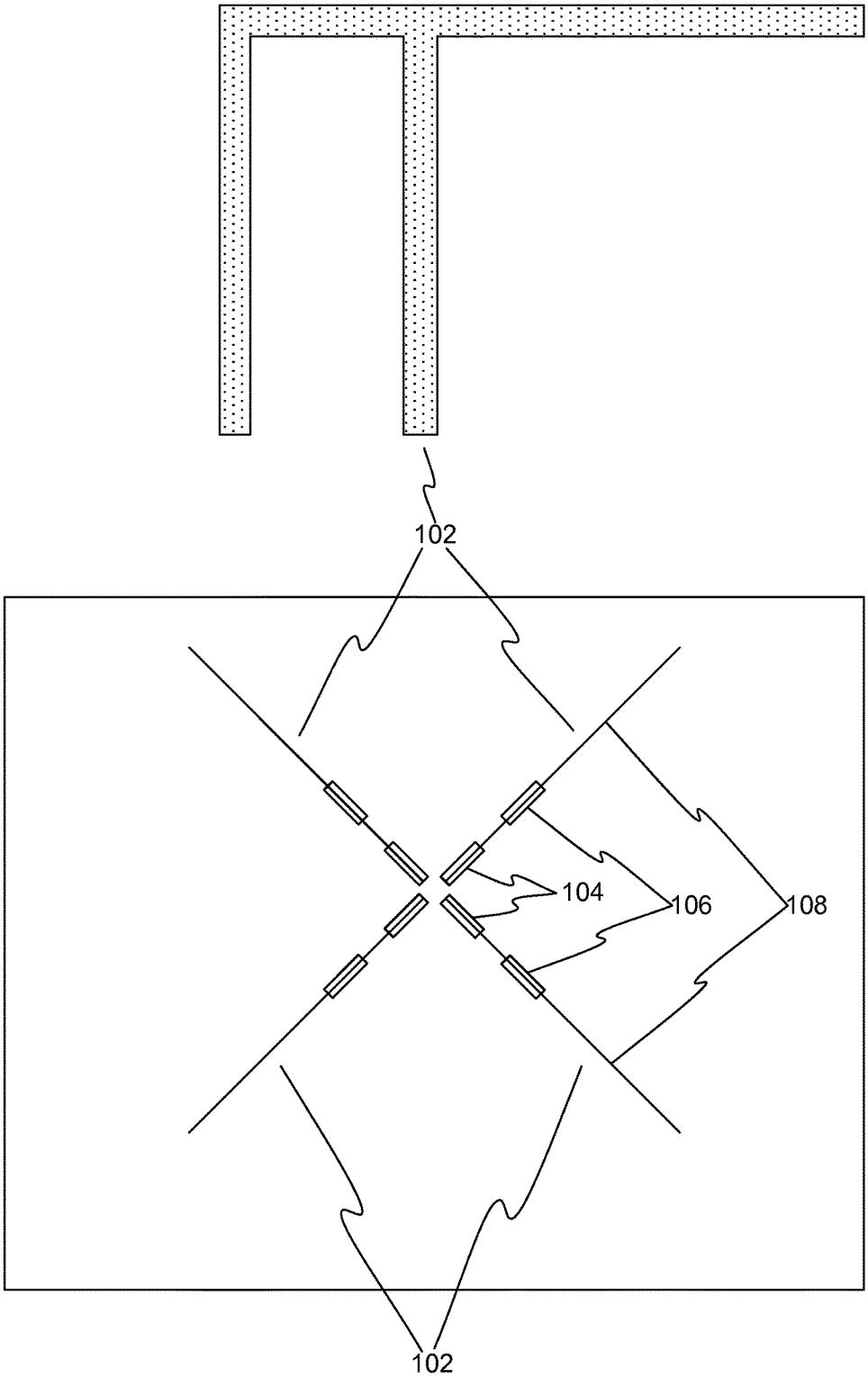
FIG. 5 shows an overhead view of PIFAs of the PIFA array.
Figure 6:
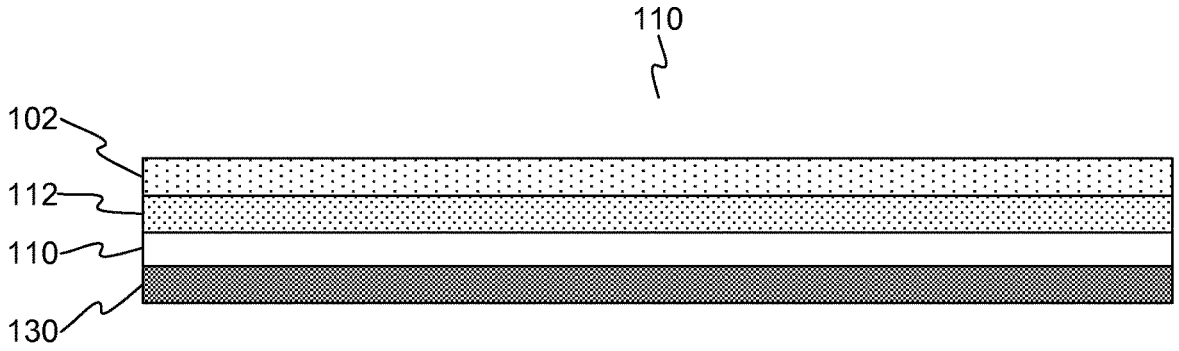
FIG. 6 shows a side view of the PIFA array.

FIG. 5 shows an overhead view of the PIFAs 102. In FIG. 5, for illustration, rectangles represent the shorting elements 104 and the feeder elements 106. In actual implementations, the shorting elements 104 and feeder elements 106 may or may not have the overhead appearance as shown in FIG. 5. FIG. 6 shows a side view of the PIFA array 100. The layers in FIG. 6 are intended to show relative arrangement, not scale.

Figure 7:
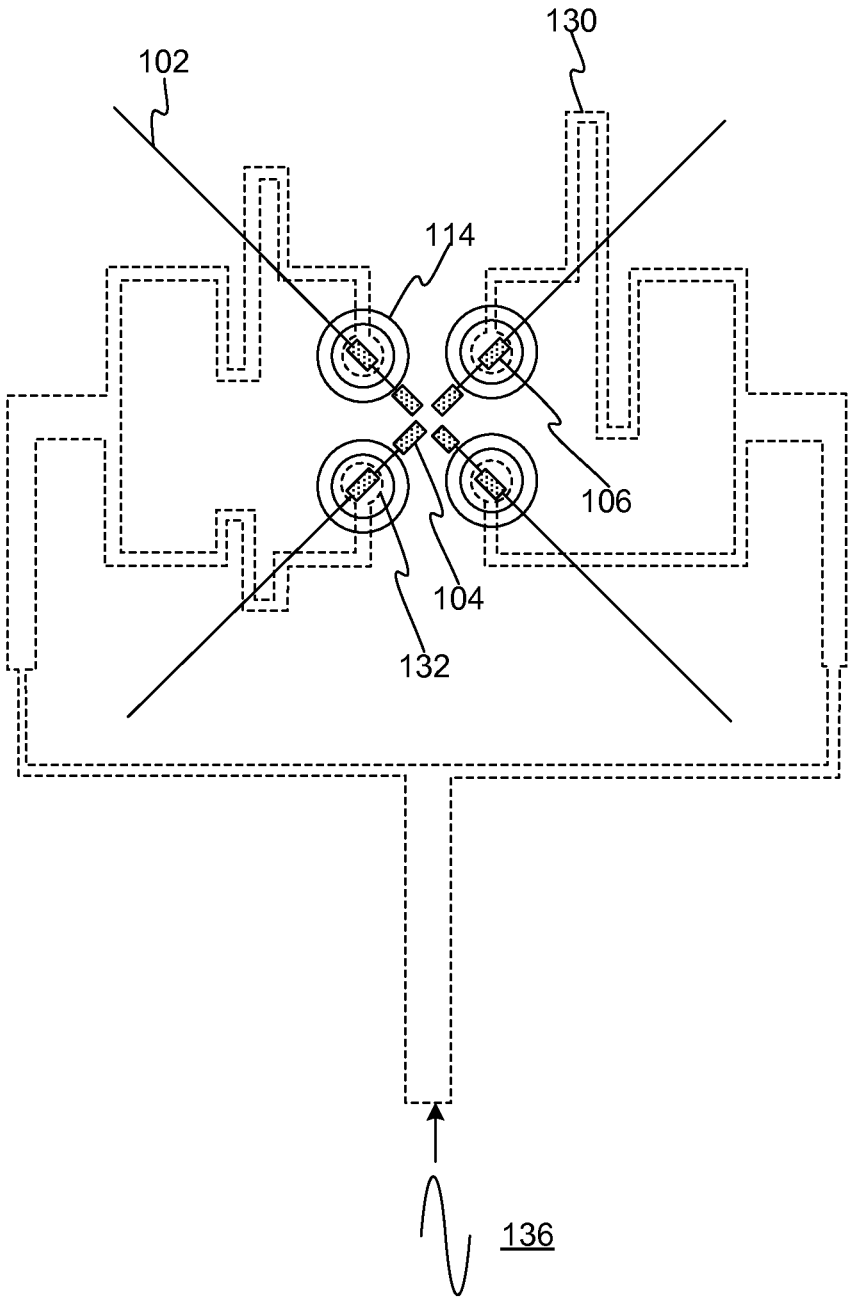
FIG. 7 shows another overhead view of the PIFA array.

FIG. 7 shows another overhead view of the PIFA array 100. Again, the shorting elements 104 contact the conductive layer 112, and the feeder elements 106 contact the contact pads 132 of the feeder circuit 130. Signal 136 flows from a source, through the feeder circuit 130 and contact pads 132 to the feeder elements 106. Relative phases of the signal 136 (and perhaps lack of the signal 136) at the feeder elements 106 will vary according to whether the source is in a directional or omni-directional communication mode.

Figure 8:
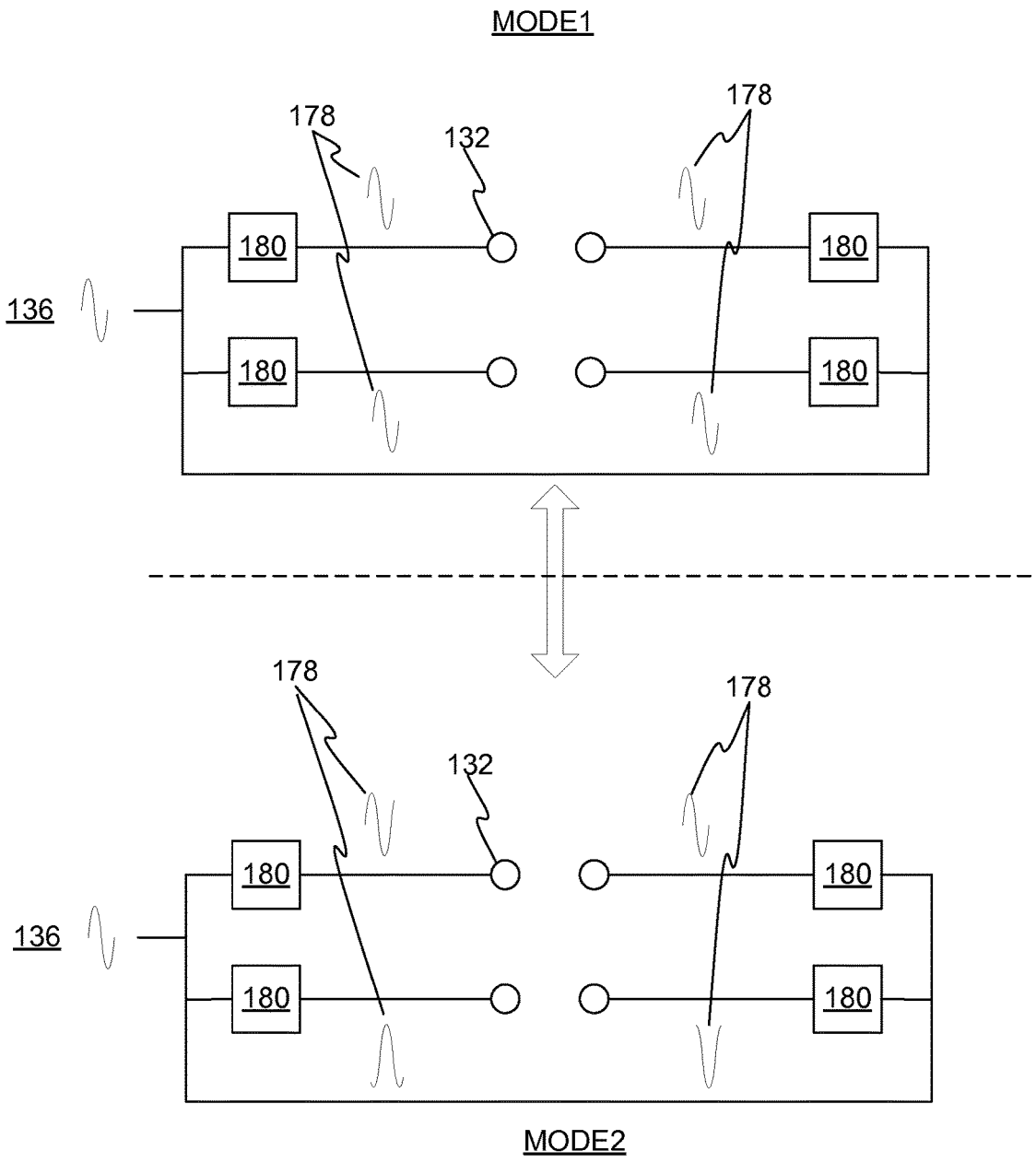
FIG. 8 shows phase adjusters feeding a source signal to contact pads.

FIG. 8 shows phase adjusters 180 feeding source signal 136 to contact pads 132. The signal 136 may be split into component signals 178. The signals shown in FIG. 8 are only for illustration. In one embodiment, the phase adjusters or shifters 180 comprise circuitry between a source of the input signal 136 and the pads 132. The phase adjusters 180 may be simple switches that that switch paths (of different length) between the source and the contact pads 132. For example, a single contact pad 132 may have two electrical paths to the signal source. Each path is a different length. If a mobile device containing the PIFA array 100 is in an omni-directional mode, a switch (e.g., a logic element) may open a first path (e.g., short) and close a second path (e.g., long), and the switch may reverse the paths when in a directional mode. In another embodiment, the phase adjusters 180 may be phase shifter circuits between the signal source and the contact pads 132, respectively. Any known technique for adjusting phase and/or other signal properties such as frequency, amplitude, etc., maybe used to create signal differences suitable for different communication modes. In other embodiments, a single phase adjuster 180 may supply two contact pads 132. In the example of FIG. 1 using four PIFAs 102, each phase adjuster 180 would drive a pair of PIFAs 102. Note that in FIG. 8, MODE1 and MODE2 are arbitrary; either MODE1 or MODE2 might be a directional mode, depending on particulars of the implementation.

Figure 9:
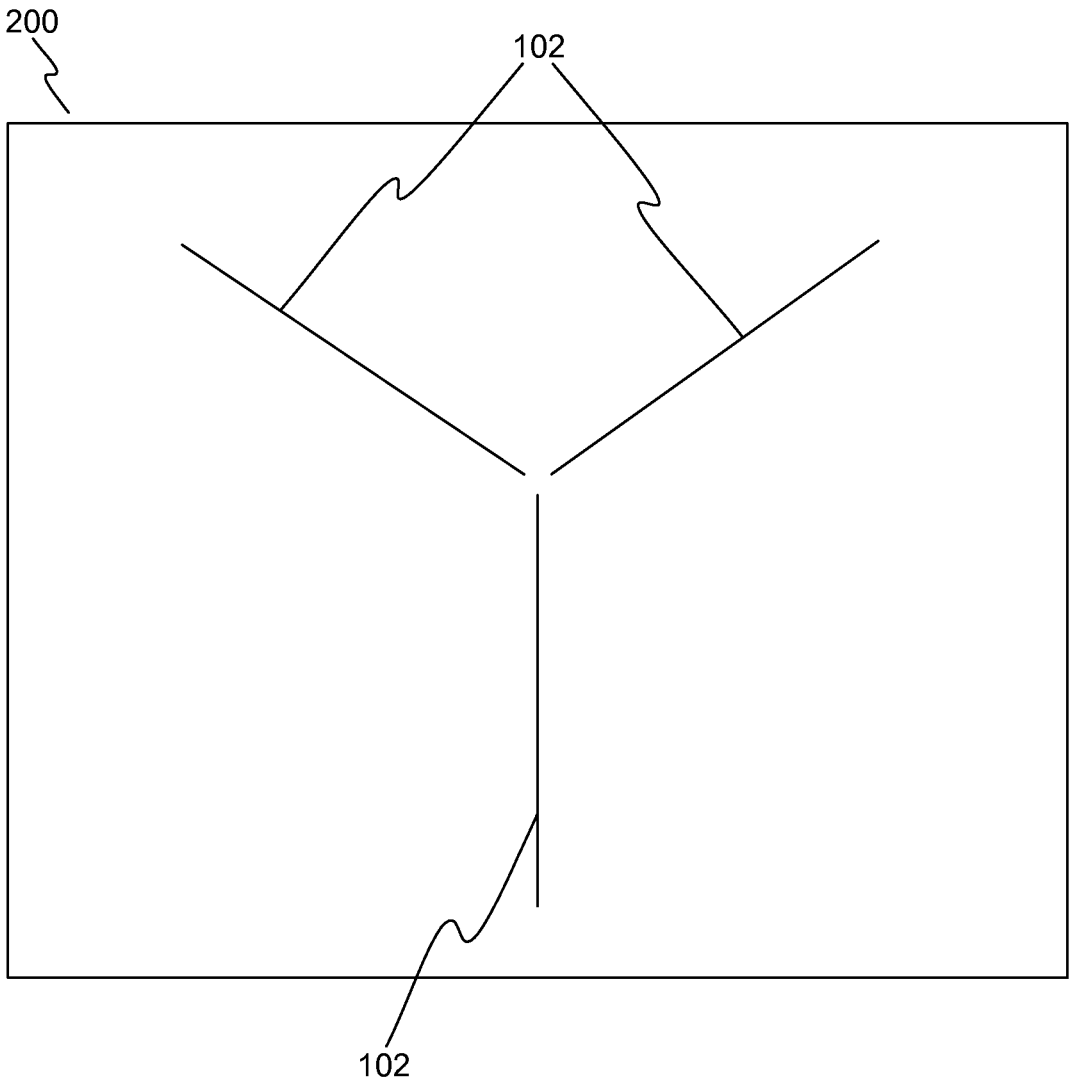
FIG. 9 shows a second antenna with an alternative arrangement of PIFAs.
Figure 10:
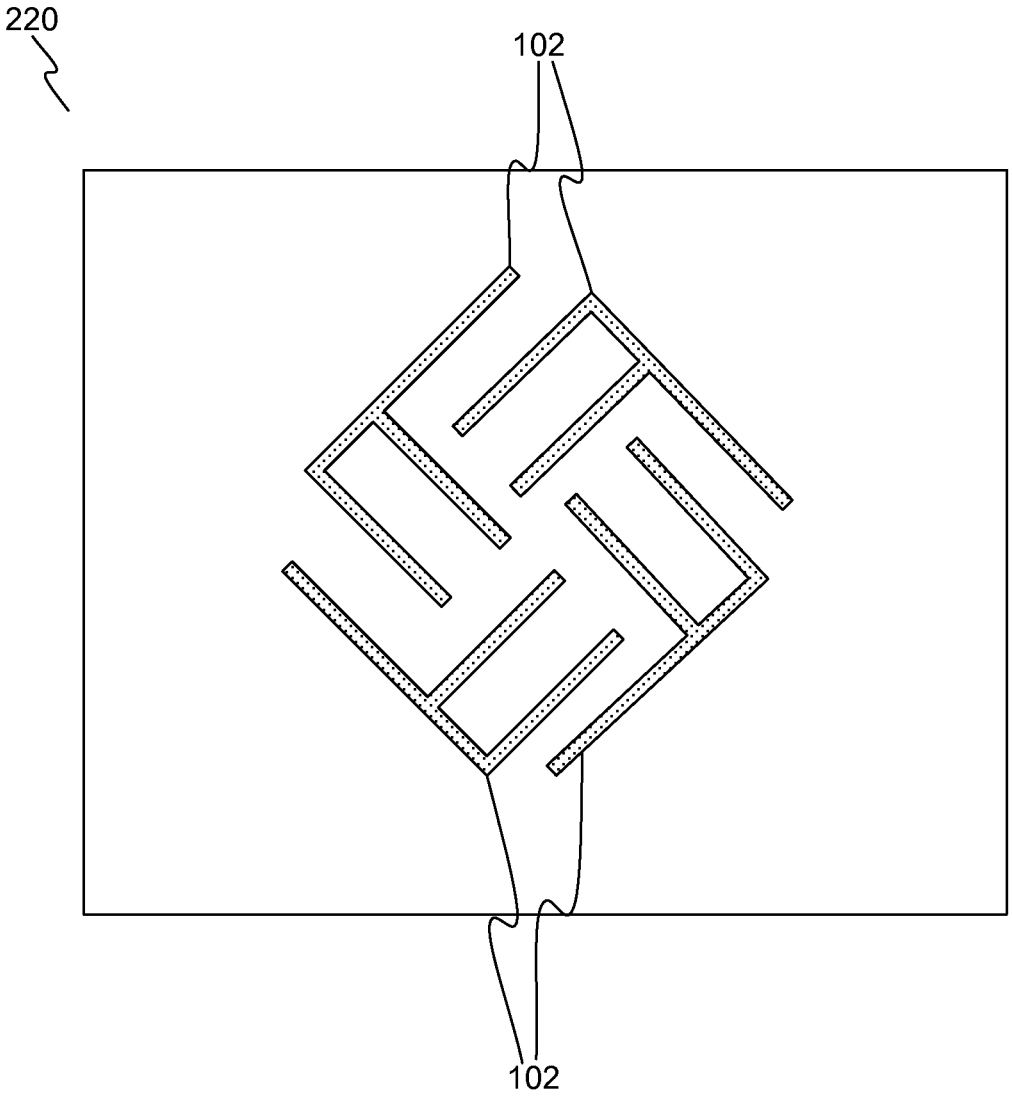
FIG. 10 shows a third antenna array.

FIG. 9 shows a second antenna 200 with an alternative arrangement of PIFAs 102. In this embodiment, three PIFAs 102 are used. FIG. 10 shows a third antenna array 220. In this example, the PIFAs 102 are arranged flat on a substrate or circuit board, again, with feeder circuit on an opposite side connecting to feeder parts of the PIFAs 102. A ground plane may be sandwiched between substrate layers or surrounding the PIFAs 102 but only contacting at the ground elements of the PIFAs 102.

Figure 11:
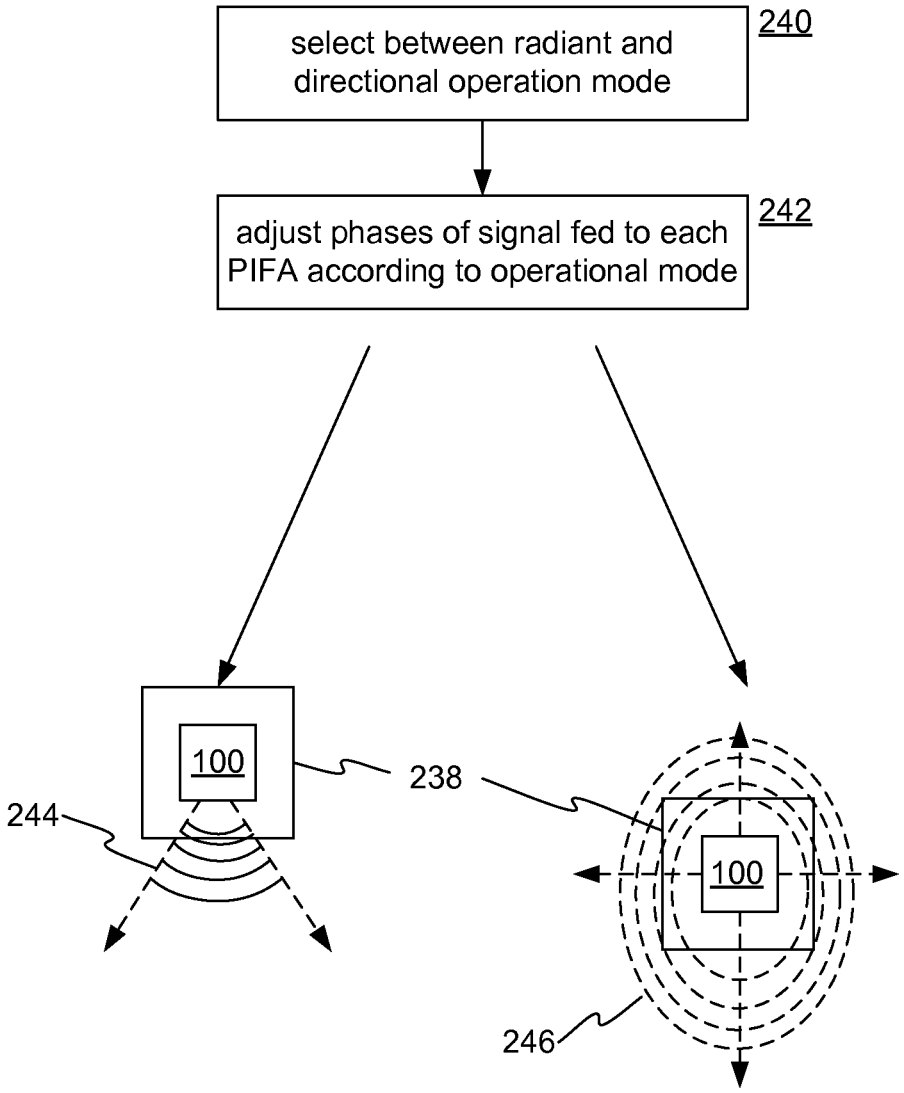
FIG. 11 shows a process performed by a device with a PIFA array.

FIG. 11 shows a process performed by a device 238 with PIFA array 100. The process involves the device 238 switching between communication modes with respective radiation patterns. The device 238 may be a cell phone, a smart card, an RF based digital credit card, a laptop, etc. At step 240, the device 238 selects between a radiant (omni-directional) communication mode and a directional operation mode. For example, if the device 238 (perhaps an application running thereon) determines that the NFC protocol is to be used, the device 238 may switch to directional mode. If the device 238 determines at step 240 that WiFi or Bluetooth is currently needed, perhaps for another application, then it would switch to the omni-directional mode. At step 242, the device adjusts the phases or other signal properties of the signals fed to each PIFA in accordance with the selected operational mode. In the directional mode, the PIFA array 100 may have a directional radiation pattern 144 with energy substantially in a directional range relative to the device 238. In an omni-directional mode the PIFA array 100 may have an omni-directional radiation pattern 246 with energy substantially in all directions from the device 238, although not usually with precise uniformity (see FIGS. 12 and 13 for example radiation patterns).

In one embodiment, the device 238 sustains one mode or the other to form corresponding types of communication links. In another embodiment, the device multiplexes the PIFA array 100 by rapidly switching between directional and omni-directional mode. In this way, the device can simultaneously communicate in both modes, albeit with reduced throughput rates.

Figure 12:
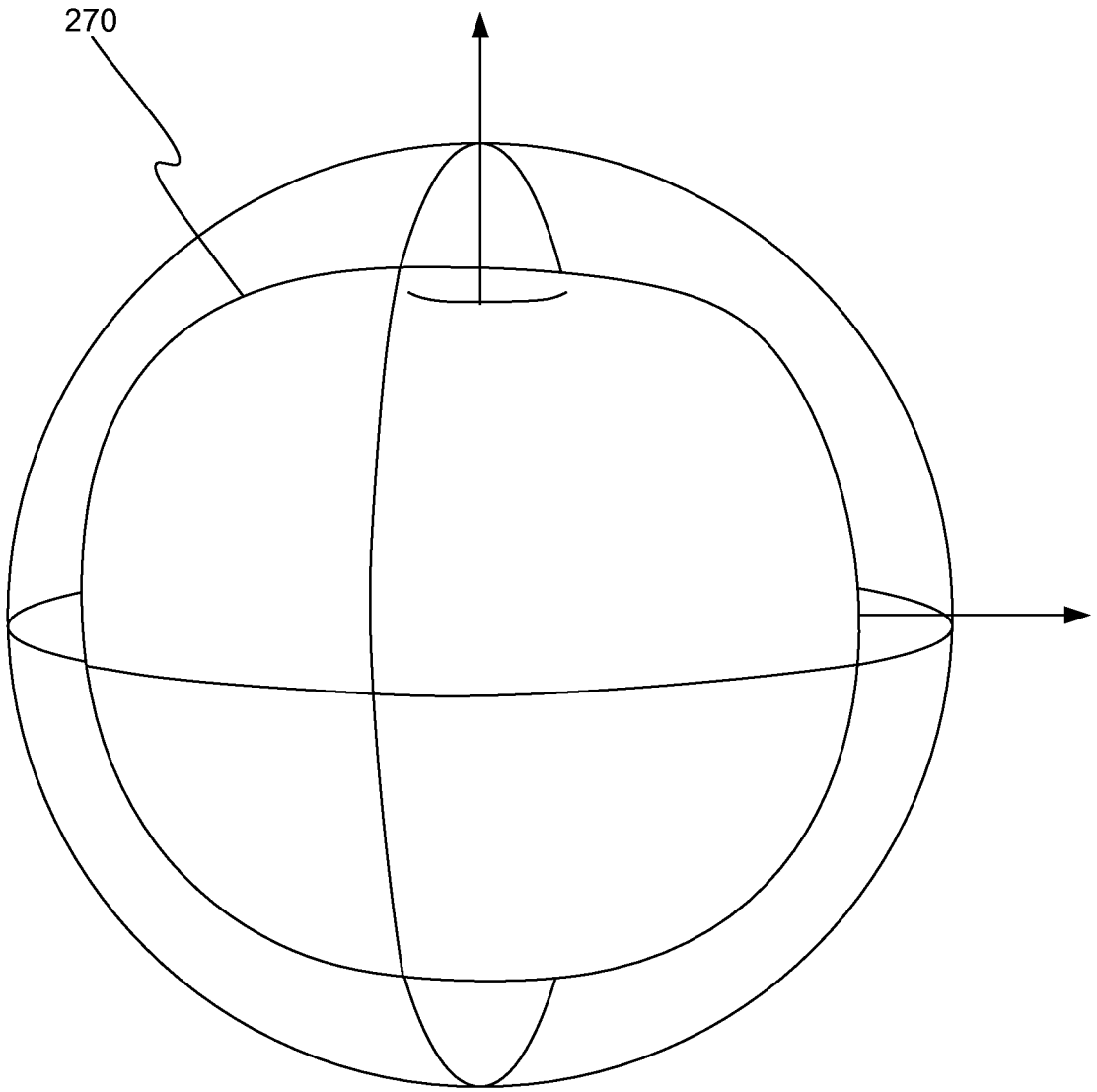
FIG. 12 shows an example omni-directional radiation pattern.
Figure 13:
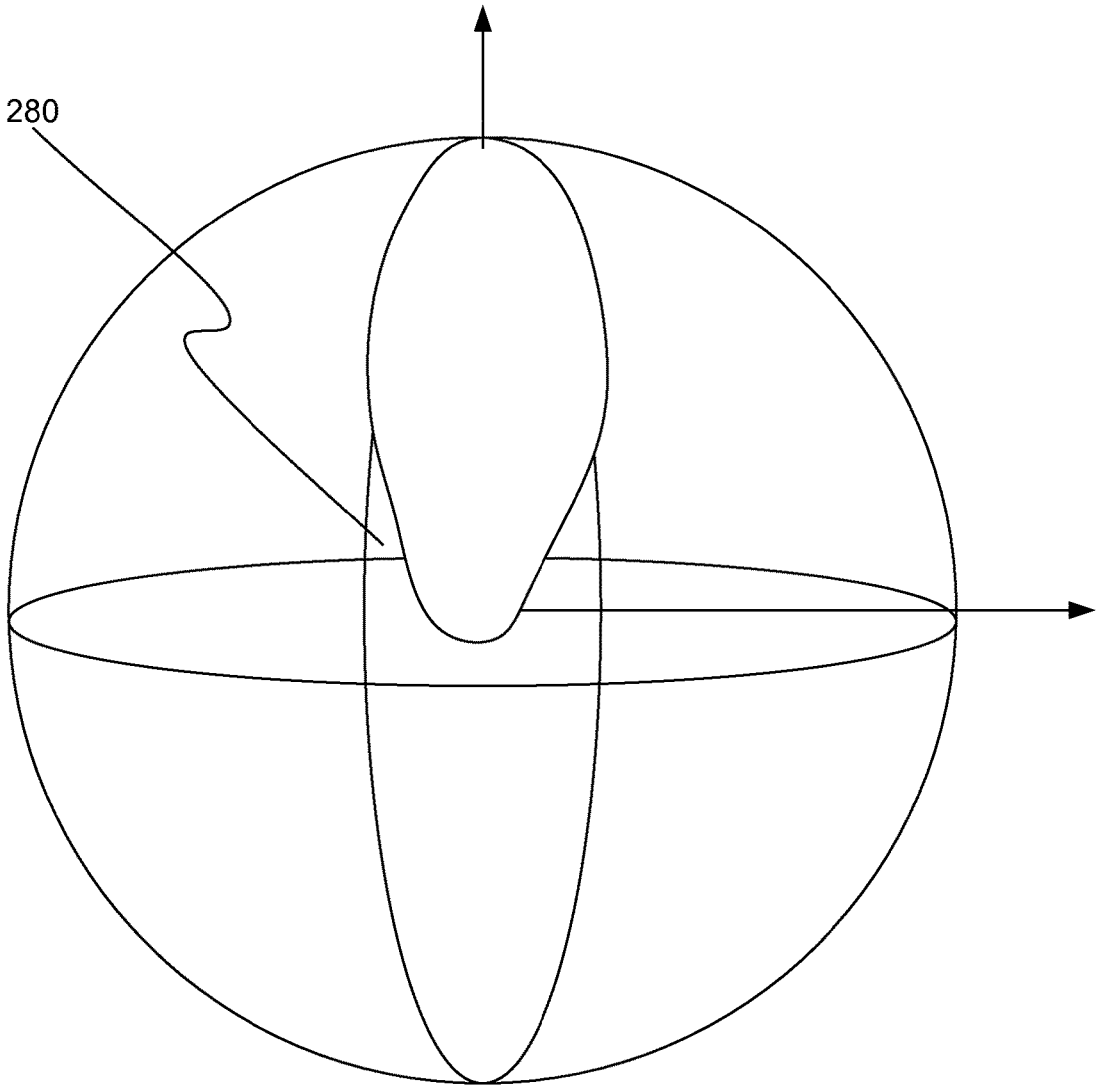
FIG. 13 shows an example directional radiation pattern 280.

FIG. 12 shows an example omni-directional radiation pattern 270. The nature of the radiation pattern for a PIFA array in omni-directional model will vary according to implementation. A uniform pattern is unlikely, but in general, the energy is distributed such that sufficient energy is available in most directions. FIG. 13 shows an example directional radiation pattern 280 (the scale of FIG. 13 is not necessarily the same as the scale in FIG. 12). In this example, energy radiates primarily upward in the figure. The patterns in FIGS. 12 and 13 are oriented relative to FIG. 6; the plan of the array in FIG. 6 would have the same orientation if shown in FIGS. 12 and 13.

Figure 14:
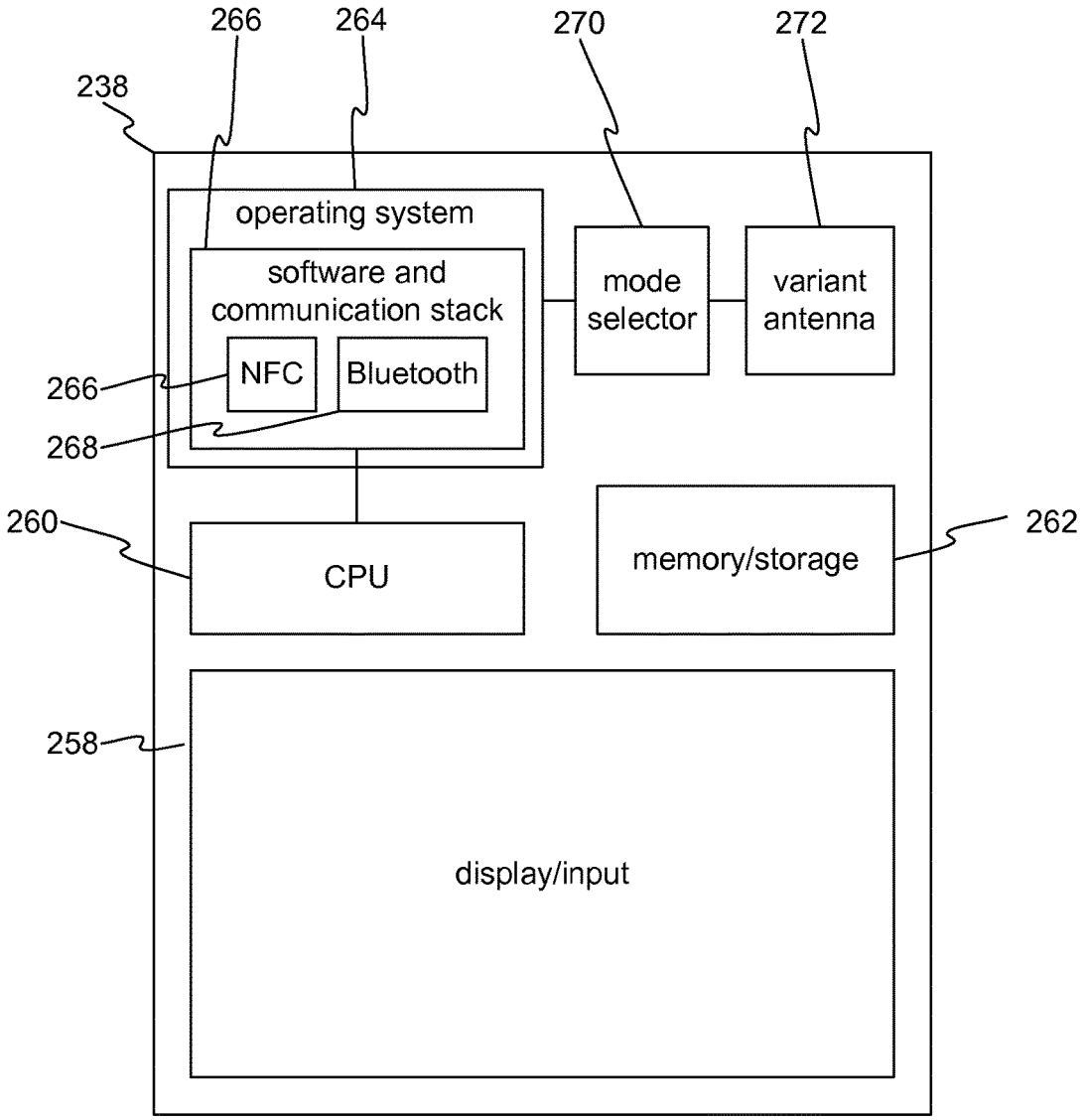
FIG. 14 shows an example of device.

FIG. 14 shows an example of device 238. The device has a display/input device 258, a central processing unit (CPU) 260 and memory or storage 262, operating together to execute an operating system 264. Application and communication software 266 run within and/or as part of the operating system 264. Various protocol implementations 266, 268 are running on the device 238. When communication software or operating system 264 determine that directional (or omni-directional) communication is needed, a mode selector is signaled accordingly, thus shifting a variant antenna 272 (e.g., PIFA array 100) to a directional or omni-directional radiation pattern. The mode selector 270 may control phase adjusters 180, for example, or may be considered the phase adjusters 180 as a group.

In one embodiment, when an application is using a directional protocol implementation 266 (e.g., NFC or another directional protocol), the device, through mode selector 270, selects the directional mode of the variant antenna 272. When an application is using an omni-directional protocol implementation 268 (e.g., Bluetooth), the mode selector 270 puts the variant antenna 272 into the omni-directional mode.

Regarding directional and omni-directional patterns, ring-type patterns are considered to be a type of omni-directional pattern. Other patterns that are considered to be omni-directional are bowl shaped patterns where, instead of having a traditional omni-directional radiation pattern that is parallel to a horizontal plane, the pattern is rotated 45 degrees upwards (between a horizontal and vertical plane) but is nonetheless circular within a horizontal plane. In addition, in some embodiments, turning one PIFA on can give a directional pattern that is shifted by some implementation-specific number of degrees.

In conclusion, it should be noted that the PIFA arrays described above, and methods of using same, can be used in any type of device. Different PIFA configurations may be used. Phases of a signal at each PIFA (or other signal differences) may determine a radiation pattern of the PIFA array. A device or software thereon may communicate directionally or omni-directionally through the same PIFA array.

The invention claimed is:

1. An apparatus comprising:

a planar circular array antenna comprising a plurality of inverted-F antenna elements in a planar arrangement, and a substrate between the inverted-F antenna elements;

a feeder circuit comprising conductive paths that respectively connect the inverted-F antenna elements with a signal source providing a signal to the feeder circuit, the feeder circuit configured to supply a signal from the signal source to the inverted-F antenna elements through the conductive paths, wherein the feeder circuit is configured to be operated in a first mode and in a second mode, wherein when operated in the first mode the feeder circuit provides a first phase alignment of the signal through the conductive paths that causes the inverted-F antenna elements to collectively radiate electromagnetic energy with a directional radiation pattern, and wherein when operated in the second mode the feeder circuit provides a second phase alignment of the signal through the conductive paths that causes the inverted-F antenna elements to collectively radiate electromagnetic energy with an omni-directional radiation pattern.

2. An apparatus according to claim 1, wherein the conductive paths comprise respective phase shifters that provide the first phase alignment and the second phase alignment.

3. An apparatus according to claim 2, wherein in the second mode the signal is in-phase on the conductive paths when fed thereby to the inverted-F antenna elements.

4. An apparatus according to claim 1, wherein each inverted-F antenna element respectively comprises a shorting element, a feed element, and a main radiating element substantially parallel to a ground plane and which radiates substantially all of the electromagnetic energy that the respective inverted-F antenna element contributes to the directional and omni-directional radiation patterns.

5. An apparatus according to claim 4, wherein the planar arrangement of the inverted-F antenna elements comprises a circular arrangement, and wherein the main radiating elements point away from a center of the circular arrangement.

6. An apparatus according to claim 5, wherein the substrate comprises the ground plane comprising a conductive layer on a first side of the substrate, and the feeder circuit is on a second side of the substrate opposite the first side.

7. An apparatus according to claim 6, wherein the feed elements pass through the substrate and connect with the respective conductive paths of the feeder circuit, wherein the feed elements do not conductively contact the conductive layer, and wherein the shorting elements are conductively connected with the conductive layer.

8. An apparatus according to claim 5, wherein the main radiating elements are co-planar with, or in a plane parallel with, the ground plane.

9. A planar array element according to claim 1, wherein the inverted-F antenna elements comprise respective planar inverted-F antennas having respective planar main radiating elements parallel to a ground plane that is parallel to the substrate.

10. A planar array element according to claim 1, wherein the inverted-F antenna elements comprise respective linear main radiating elements that are parallel to a ground plane.

11. A method of operating a planar circular antenna array, the method comprising:

providing modes of operating the planar circular antenna array, the modes comprising a first mode and a second mode;

generating a source signal transmitted by the planar antenna array, the planar antenna array comprising a plurality of inverted-F antenna elements;

in response to a first control signal, entering the first mode by providing the source signal in a first phase alignment along conductive paths to the respective inverted-F antenna elements, the first phase alignment causing the planar antenna array to radiate electromagnetic energy with a directional radiation pattern; and in response to a second control signal, entering the second mode by providing the source signal in a second phase alignment along the conductive paths to the respective inverted-F antenna elements, the second phase alignment causing the planar antenna array to radiate electromagnetic energy with an omni-directional radiation pattern.

12. A method according to claim 11, further comprising determining that directional communication is required and in response generating the first control signal.

13. A method according to claim 12, further comprising determining that omni-directional communication is required and in response generating the second control signal.

14. A method according to claim 11, wherein the inverted-F antenna elements comprise respective planar inverted-F antennas (PIFAs), wherein each PIFA comprises a planar main radiation element parallel to a ground plane.

15. A device comprising:

a processor and storage coupled with the processor;

an array antenna comprised of a plurality of inverted-F antenna elements; and a feeder circuit configured to be controlled by the processor when the processor is powered, the feeder circuit further configured to feed a signal to each inverted-F antenna element in the array antenna through respective conductive paths to cause the inverted-F antenna elements to alternate between, in a first mode, collectively radiating energy with a directional radiation pattern and, in a second mode, collectively radiating energy with an omni-directional radiation pattern, wherein in the first mode the signal has a first phase alignment on the conductive paths, and wherein in the second mode the signal has a second phase alignment on the conductive paths.

16. A device according to claim 15, wherein the storage stores an operating system and/or application, wherein either or both implement a first communication protocol and a second communication protocol, wherein when the device is operating: when the first communication protocol is used, the feeder circuit causes the array antenna to radiate energy with the directional radiation pattern, and when the second communication protocol is used, the feeder circuit causes the array antenna to radiate energy with the omni-directional radiation pattern.

17. A device according to claim 15, wherein the feeder circuit comprises one or more phase shifters that cause a signal being supplied by the feeder circuit to the inverted-F antenna elements and transmitted thereby to have different phases when transmitted by the inverted-F antenna elements, respectively.

18. A device according to claim 15, wherein the inverted-F antenna elements respectively comprise main linear radiating elements, and the main linear radiating elements are arranged in an "X" pattern with respect to each other.

19. A device according to claim 15, wherein the feeder circuit enables alternation between radiating energy with the directional and omni-directional radiation patterns by altering the signal received by the feeder circuit when providing the signal to the inverted-F antenna elements.

20. A device according to claim 15, wherein each inverted-F antenna element comprises a respective planar main radiating element parallel to a ground plane.

21. A device according to claim 15, wherein the inverted-F antenna elements comprise respective linear main radiating elements that are parallel to a ground plane.

22. A device according to claim 15, wherein the omni-directional and directional radiation patterns comprise far-field radiation emitted by the array antenna.

23. A mobile computing device comprising:

an array antenna comprised of inverted-F antenna elements;

a feeder circuit configured to concurrently feed signals along respective conductive paths to the respective inverted-F antenna elements of the mobile computing device, wherein in a first mode the feeder circuit is configured to provide a first phase alignment of the signals on the conductive paths to cause the inverted-F antenna elements to collectively emit a directional radiation pattern, and wherein in a second mode the feeder circuit is configured to provide a second phase alignment of the signals on the conductive paths to cause the inverted-F antenna elements to collectively emit an omni-directional radiation pattern.

24. A mobile computing device according to claim 23, wherein the inverted-F antenna elements comprise respective planar inverted-F antennas, each comprising a respective planar main radiating element parallel to a ground plane.

25. A mobile computing device according to claim 23, wherein the inverted-F antenna elements comprise respective linear main radiation elements that are parallel to a ground plane.

* * * * *